US012050063B2

(12) United States Patent
Machida

(10) Patent No.: US 12,050,063 B2
(45) Date of Patent: Jul. 30, 2024

(54) LOOP HEAT PIPE

(71) Applicant: SHINKO ELECTRIC INDUSTRIES CO., LTD., Nagano (JP)

(72) Inventor: Yoshihiro Machida, Nagano (JP)

(73) Assignee: SHINKO ELECTRIC INDUSTRIES CO., LTD., Nagano (JP)

( * ) Notice: Subject to any disclaimer, the term of this patent is extended or adjusted under 35 U.S.C. 154(b) by 0 days.

(21) Appl. No.: 17/861,727

(22) Filed: Jul. 11, 2022

(65) Prior Publication Data

US 2023/0015059 A1 Jan. 19, 2023

(30) Foreign Application Priority Data

Jul. 14, 2021 (JP) ..... 2021-116554

(51) Int. Cl.
*F28D 15/04* (2006.01)
*F28D 15/02* (2006.01)

(52) U.S. Cl.
CPC ..... *F28D 15/043* (2013.01); *F28D 15/0233* (2013.01); *F28D 15/046* (2013.01)

(58) Field of Classification Search
CPC ..... F28D 15/04; F28D 15/02; F28D 15/043; F28D 15/0233; F28D 15/046; F28D 15/0266; F28D 2021/0029
See application file for complete search history.

(56) References Cited

U.S. PATENT DOCUMENTS

2006/0283577 A1* 12/2006 Liu ..... F28F 3/02 165/104.33
2009/0323285 A1* 12/2009 Ryoson ..... H01L 23/427 165/104.26
2016/0259383 A1* 9/2016 Shioga ..... F28D 15/0266
2018/0058767 A1* 3/2018 Machida ..... H01L 21/4882
2019/0090385 A1 3/2019 Machida et al.
2019/0242652 A1 8/2019 Machida
2021/0131742 A1 5/2021 Machida

FOREIGN PATENT DOCUMENTS

| | | |
|---|---|---|
| EP | 3 460 375 A1 | 3/2019 |
| EP | 3 816 563 A1 | 5/2021 |
| JP | 2016-90204 A | 5/2016 |
| JP | B2-6291000 | 3/2018 |
| JP | B1-6400240 | 10/2018 |

OTHER PUBLICATIONS

Extended European Search Report dated Nov. 14, 2022 issued in corresponding European application No. 22 18 3554; 7 pages.

* cited by examiner

*Primary Examiner* — Harry E Arant
(74) *Attorney, Agent, or Firm* — Rankin, Hill & Clark LLP

(57) ABSTRACT

A loop heat pipe includes: an evaporator configured to vaporize a working fluid; a condenser configured to liquefy the working fluid; a liquid pipe that connects the evaporator and the condenser to each other; and a vapor pipe that connects the evaporator and the condenser to each other. The condenser includes: a first outer metal layer; a second outer metal layer; and an inner metal layer that is provided between the first outer metal layer and the second outer metal layer, and having a flow channel through which the working fluid flows. The first outer metal layer includes: a first inner face that contacts the inner metal layer; a first outer face opposite to the first inner face in a thickness direction of the first outer metal layer; and a first recess provided in the first outer face so as not to overlap the flow channel in plan view.

1 Claim, 15 Drawing Sheets

LOOP HEAT PIPE

This application claims priority from Japanese Patent Applications No. 2021-116554, filed on Jul. 14, 2021, the entire contents of which are herein incorporated by reference.

BACKGROUND

Technical Field

The present disclosure relates to a loop heat pipe.

Background Art

In the background art, heat pipes each of which transports heat using a phase change of a working fluid have been proposed as devices for cooling heating components of semiconductor devices (such as CPUs) mounted on electronic apparatuses (e.g. see Japanese Patent Nos. 6291000 and 6400240).

As an example of such a heat pipe, there has been known a loop heat pipe including an evaporator that vaporizes a working fluid by heat of a heating component, and a condenser that cools and liquefies the vaporized working fluid. In the loop heat pipe, the evaporator and the condenser are connected to each other through a liquid pipe and a vapor pipe, that form a loop-like flow channel. In the loop heat pipe, the working fluid flows through the loop-like flow channel in one direction.

By the way, an improvement in heat dissipation performance of the aforementioned loop heat pipe has been desired, but there is still room for improvement in this respect.

SUMMARY

A certain embodiment provides a loop heat pipe. The loop heat pipe includes: an evaporator configured to vaporize a working fluid; a condenser configured to liquefy the working fluid; a liquid pipe that connects the evaporator and the condenser to each other; and a vapor pipe that connects the evaporator and the condenser to each other. The condenser includes: a first outer metal layer; a second outer metal layer; and an inner metal layer that is provided between the first outer metal layer and the second outer metal layer, and having a flow channel through which the working fluid flows. The first outer metal layer includes: a first inner face that contacts the inner metal layer; a first outer face opposite to the first inner face in a thickness direction of the first outer metal layer; and a first recess that is provided in the first outer face so as not to overlap the flow channel in plan view.

A certain embodiment provides a loop heat pipe. The loop heat pipe includes: an evaporator configured to vaporize a working fluid; a condenser configured to liquefy the working fluid; a liquid pipe that connects the evaporator and the condenser to each other; a vapor pipe that connects the evaporator and the condenser to each other; and a flow channel that is provided in the liquid pipe, the vapor pipe and the condenser to allow the working fluid to flow therethrough. At least one of the condenser, the liquid pipe and the vapor pipe includes: a first outer metal layer; a second outer metal layer; and an inner metal layer that is provided between the first outer metal layer and the second outer metal layer. The first outer metal layer includes: a first inner face that contacts the inner metal layer; a first outer face opposite side to the first inner face in a thickness direction of the first metal layer; and a first recess that is provided in the first outer face so as not to overlap the flow channel in plan view.

DETAILED DESCRIPTION OF EMBODIMENT

An embodiment will be described below with reference to the accompanying drawings. Incidentally, for convenience, the accompanying drawings may show each characteristic portion in an enlarged manner in order to make the characteristic easy to understand, and a dimensional ratio among constituent elements may be different among the drawings. Further, in order to make sectional structures of members easy to understand in sectional view, some of the members to be hatched will be not hatched but drawn in a satin pattern. In each drawing, X-, Y- and Z-axes that are orthogonal to one another are shown. In the following description, for convenience, a direction extending along the X-axis will be referred to as X-axis direction, a direction extending along the Y-axis will be referred to as Y-axis direction, and a direction extending along the Z-axis will be referred to as Z-axis direction. Incidentally, in the present specification, a "plan view" will be referred to as a view of an object from a vertical direction (the Z-axis direction in this case) of FIG. 2 etc., and a "planar shape" will be referred to as a shape of the object viewed from the vertical direction of FIG. 2 etc.

(Overall Configuration of Loop Heat Pipe 10)

Figure 1:
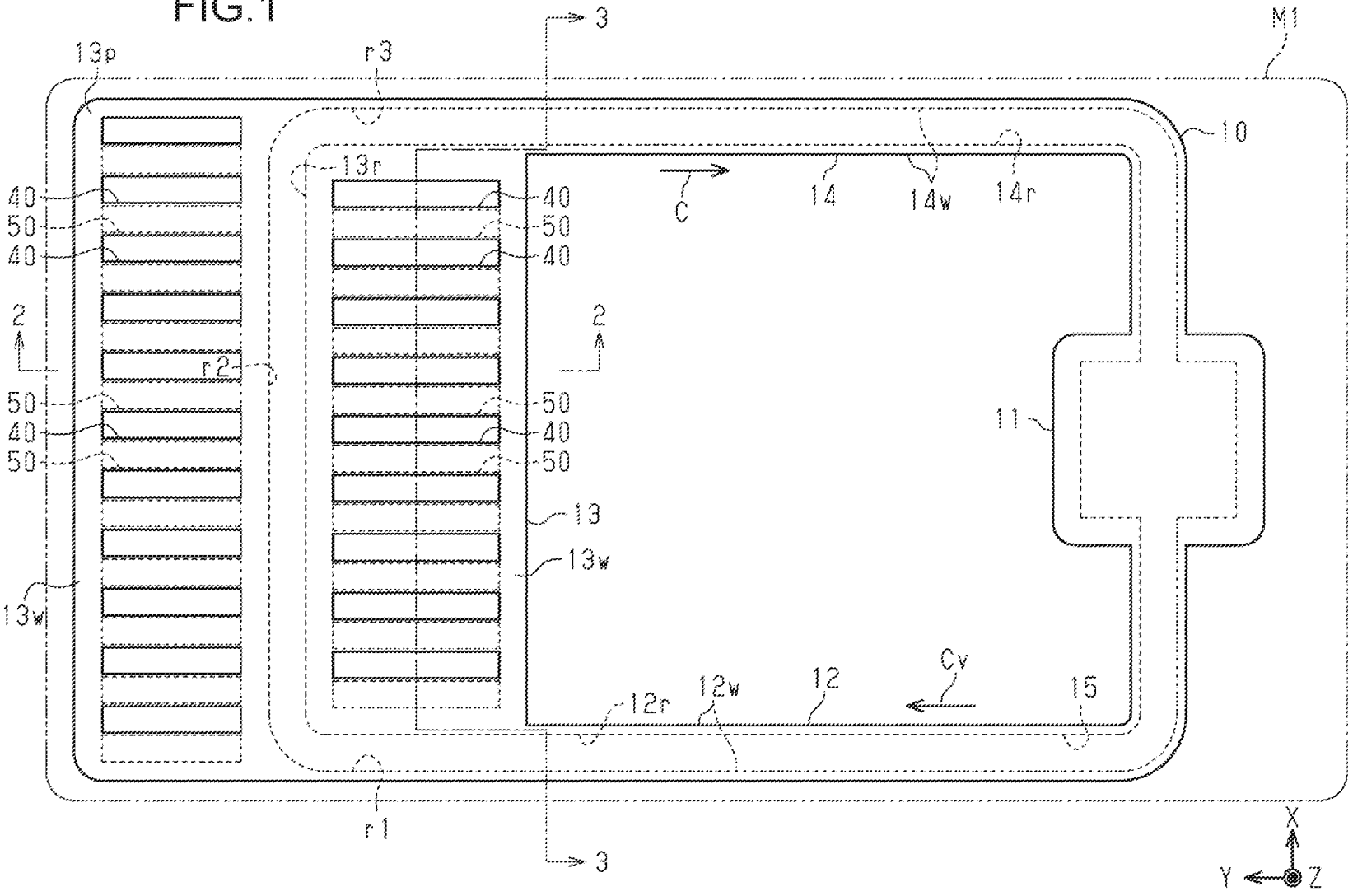
FIG. 1 is a schematic plan view showing a loop heat pipe according to an embodiment.

A loop heat pipe 10 as shown in FIG. 1 is, for example, housed in a mobile type electronic apparatus M1 such as a smartphone or a tablet terminal. The loop heat pipe 10 has an evaporator 11, a vapor pipe 12, a condenser 13, and a liquid pipe 14.

The evaporator 11 and the condenser 13 are connected to each other by the vapor pipe 12 and the liquid pipe 14. The evaporator 11 is configured to vaporize a working fluid C to generate vapor Cv. The vapor Cv generated in the evaporator 11 is sent to the condenser 13 through the vapor pipe 12. The condenser 13 is configured to liquefy the vapor Cv of the working fluid C. The liquefied working fluid C is sent to the evaporator 11 through the liquid pipe 14. The vapor pipe 12 and the liquid pipe 14 form a loop-like flow channel 15 which allows the working fluid C or the vapor Cv to flow therethrough.

The vapor pipe 12 is, for example, formed into a long tubular body. The liquid pipe 14 is, for example, formed into a long tubular body. In the present embodiment, the vapor pipe 12 and the liquid pipe 14 are, for example, equal in dimension in a length direction (i.e. length) to each other. Incidentally, the length of the vapor pipe 12 and the length of the liquid pipe 14 may be different from each other. For example, the length of the vapor pipe 12 may be shorter than the length of the liquid pipe 14. Here, the "length direction" of the evaporator 11, the vapor pipe 12, the condenser 13, and the liquid pipe 14 in the present specification is a direction consistent with a direction (see arrows in FIG. 1) in which the working fluid C or the vapor Cv in each member flows. In addition, in this specification, the term "equal" includes a case where objects to be compared are exactly equal, and a case where the objects are slightly different due to a dimensional tolerance etc.

(Configuration of Evaporator 11)

The evaporator 11 is fixed in close contact with a not-shown heating component. The working fluid C in the evaporator 11 is vaporized by heat generated in the heating component, so that the vapor Cv is generated. Incidentally, a thermal interface material (TIM) may be interposed between the evaporator 11 and the heating component. The TIM reduces thermal contact resistance between the heating component and the evaporator 11 to make the heat be conducted from the heating component to the evaporator 11 smoothly.

(Configuration of Vapor Pipe 12)

The vapor pipe 12 has, for example, a pair of pipe walls 12*w* that are provided on opposite sides in a width direction orthogonal to the length direction of the vapor pipe 12 in plan view, and a flow channel 12*r* that is provided between the pair of pipe walls 12*w*. The flow channel 12*r* communicates with an internal space of the evaporator 11. The flow channel 12*r* is a part of the loop-like flow channel 15. The vapor Cv generated in the evaporator 11 is guided to the condenser 13 through the vapor pipe 12.

(Configuration of Condenser 13)

The condenser 13 has, for example, a heat dissipating plate 13*p* whose area has been enlarged for heat dissipation, and a flow channel 13*r* that is provided inside the heat dissipating plate 13*p*. The flow channel 13*r* has a flow channel r1 that communicates with the flow channel 12*r* and extends along the Y-axis direction, a flow channel r2 that is bent from the flow channel r1 and extends along the X-axis direction, and a flow channel r3 that is bent from the flow channel r2 and extends along the Y-direction. The flow channel 13*r* (the flow channels r1 to r3) is a part of the loop-like flow channel 15. The condenser 13 has pipe walls 13*w* provided on opposite sides in a direction orthogonal to the length direction of the flow channel 13*r*, i.e. the flow channels r1 to r3. The vapor Cv guided through the vapor pipe 12 is liquefied in the condenser 13.

(Configuration of Liquid Pipe 14)

The liquid pipe 14 has, for example, a pair of pipe walls 14*w* that are provided on opposite sides in a width direction orthogonal to the length direction of the liquid pipe 14 in plan view, and a flow channel 14*r* that is provided between the pair of pipe walls 14*w*. The flow channel 14*r* communicates with the flow channel 13*r* (specifically the flow channel r3) of the condenser 13, and communicates with the internal space of the evaporator 11. The flow channel 14*r* is a part of the loop-like flow channel 15. The working fluid C liquefied in the condenser 13 is guided to the evaporator 11 through the liquid pipe 14.

(Configuration of Loop Heat Pipe 10)

In the loop heat pipe 10, the heat generated in the heating component moves to the condenser 13 to be dissipated in the condenser 13. Thus, the heating component is cooled so that an increase in temperature of the heating component can be suppressed.

It is preferable that a fluid high in vapor pressure and large in latent heat of vaporization is used as the working fluid C. By use of such a working fluid C, the heating component can be efficiently cooled by the latent heat of vaporization. For example, ammonia, water, chlorofluorocarbon, alcohol, acetone, or the like, can be used as the working fluid C.

(Specific Structure of Condenser 13)

Figure 2:
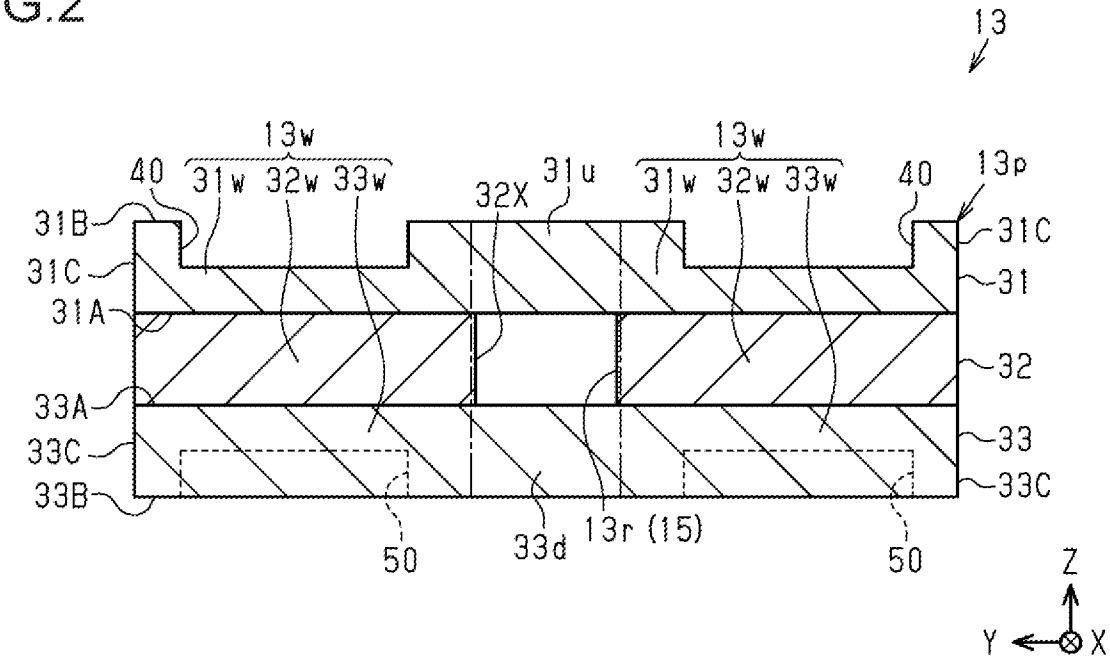
FIG. 2 is a schematic sectional view (sectional view taken along a line 2-2 in FIG. 1) showing a condenser according to the embodiment.
Figure 3:
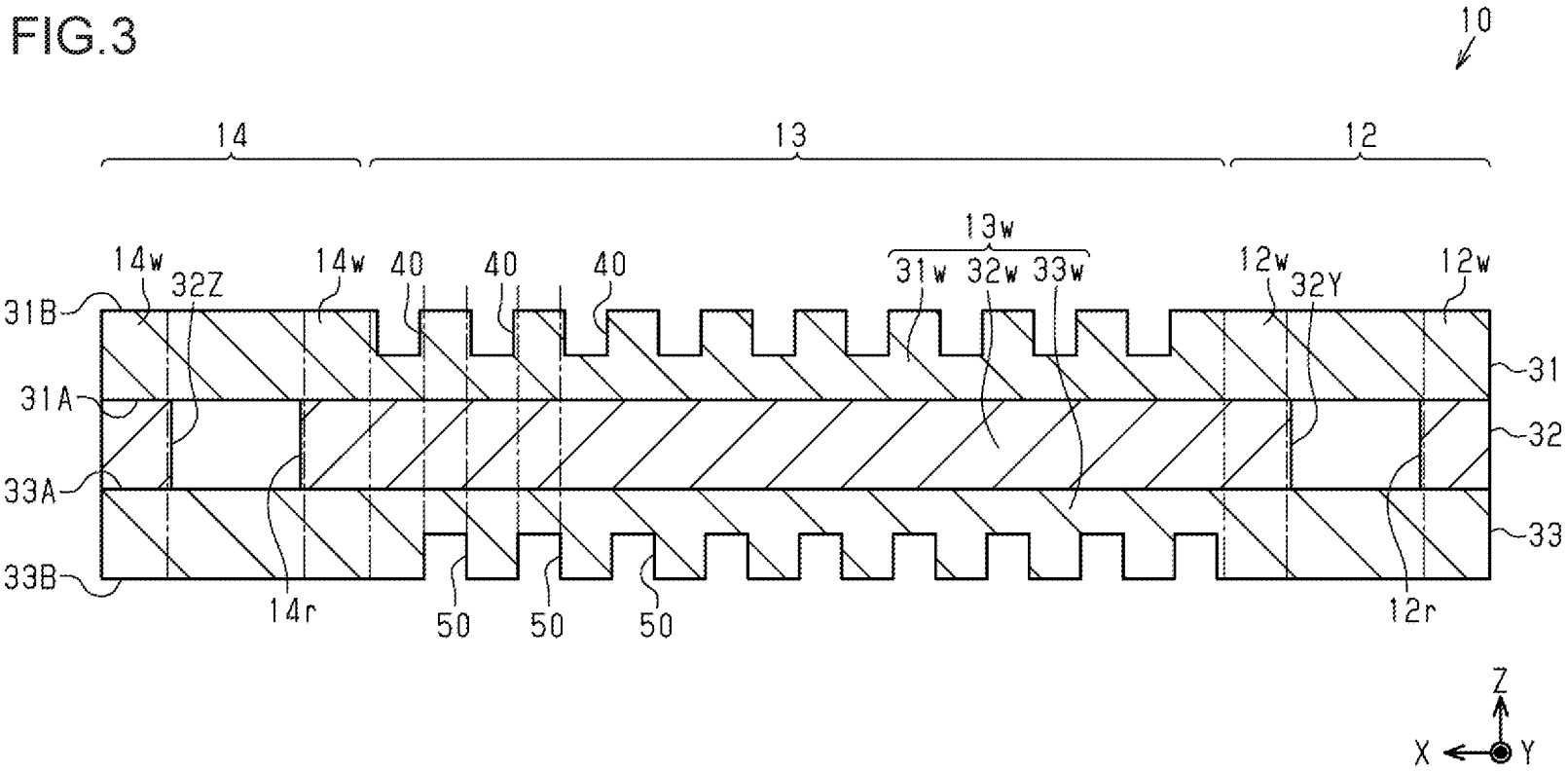
FIG. 3 is a schematic sectional view (sectional view taken along a line 3-3 in FIG. 1) showing the loop heat pipe according to the embodiment.

FIG. 2 shows a section of the condenser 13 taken along a line 2-2 in FIG. 1. This section is a plane orthogonal to a direction in which the working fluid C flows in the condenser 13. Specifically, the section shown in FIG. 2 is a section in which the condenser 13 is cut by a YZ plane orthogonal to the length direction of the flow channel r2. FIG. 3 shows a section of the loop heat pipe 10 taken along a line 3-3 in FIG. 1. This section is a section in which the condenser 13 is cut by an XZ plane extending in parallel with the flow channel r2.

As shown in FIG. 2, the condenser 13 has, for example, a structure in which three metal layers 31, 32, and 33 are deposited on one another. In other words, the condenser 13 has a structure in which the metal layer 32 serving as an inner metal layer is deposited between the metal layers 31 and 33 serving as a pair of outer metal layers. The inner metal layer of the condenser 13 in the present embodiment is constituted by only one metal layer 32.

Each of the metal layers 31 to 33 is, for example, a copper (Cu) layer excellent in heat conductivity. The metal layers 31 to 33 are, for example, directly bonded to one another by solid-phase bonding such as diffusion bonding, pressure welding, friction welding or ultrasonic bonding. Incidentally, to make it easy to understand in FIG. 2, the metal layers 31 to 33 are distinguished from one another by a solid line. When, for example, the metal layers 31 to 33 are integrated by the diffusion bonding, an interface between adjacent ones of the metal layers 31 to 33 may disappear so that a boundary therebetween may be unclear. Here, the solid-phase bonding is a method in which objects to be bonded are not melted into each other but softened by heat in a solid-phase (solid) state, and then plastically deformed by further heat to be bonded to each other. Incidentally, each of the metal layers 31 to 33 is not limited to the copper layer, but may be formed of a stainless steel layer, an aluminum layer, a magnesium alloy layer, or the like. Further, a material used for forming some of the deposited metal layers 31 to 33 may be different from a material used for forming the others of the metal layers 31 to 33. Thickness of each of the metal layers 31 to 33 can be, for example, set in a range of about 50 μm to 200 μm. Incidentally, some of the metal layers 31 to 33 may be set to be different in thickness from the others of the metal layers 31 to 33, or all the metal layers 31 to 33 may be set to be different in thickness from one another.

The condenser 13 that is made up of the metal layers 31 to 33 deposited in the Z-axis direction has the flow channel 13*r*, and a pair of the pipe walls 13*w* that are provided on the opposite sides of the flow channel 13*r* in the Y-axis direction.

(Configuration of Metal Layer 32)

The metal layer 32 is deposited between the metal layer 31 and the metal layer 33. An upper face of the metal layer 32 is bonded to the metal layer 31. A lower face of the metal layer 32 is bonded to the metal layer 33. The metal layer 32 has a through hole 32X that penetrates the metal layer 32 in the thickness direction, and a pair of pipe walls 32*w* that are provided on opposite sides of the through hole 32X in the Y-axis direction. The through hole 32X constitutes the flow channel 13*r*.

(Configuration of Metal Layer 31)

The metal layer 31 is deposited on the upper face of the metal layer 32. The metal layer 31 has an inner face 31A (a lower face in this case) that is bonded to the metal layer 32, and an outer face 31B (an upper face in this case) that is provided on an opposite side to the inner face 31A in the thickness direction (the Z-axis direction in this case) of the metal layer 31. The metal layer 31 has pipe walls 31*w* that are provided at positions overlapping the pipe walls 32*w* in plan view, and an upper wall 31*u* that is provided at a position overlapping the flow channel 13*r* in plan view. The inner face 31A in each of the pipe walls 31*w* is bonded to the upper face in a corresponding one of the pipe walls 32*w*. The upper wall 31*u* is provided between a pair of the pipe walls 31*w*. The inner face 31A in the upper wall 31*u* is exposed to the flow channel 13*r*. In other words, the upper wall 31*u* constitutes the flow channel 13*r*.

The metal layer 31 has one or more recesses 40 in the outer face 31B. The recesses 40 are provided so as not to overlap the flow channel 15, specifically the flow channel 13*r*, in plan view. The recesses 40 are provided in the outer face 31B in the pipe walls 31*w*. The recesses 40 are, for example, provided in both the pair of the pipe walls 31*w*. The recesses 40 are not provided in the outer face 31B in the upper wall 31*u*. Each of the recesses 40 is, for example, formed to be recessed from the outer face 31B of the metal layer 31 to a corresponding one of thicknesswise intermediate portions of the metal layer 31. Each of the recess 40 is, for example, formed to extend from the outer face 31B of the metal layer 31 to a corresponding one of thicknesswise central portions of the metal layer 31.

As shown in FIG. 3, the metal layer 31 has the plurality of recesses 40 that are arranged side by side along one direction (the X-axis direction in this case) of a plane direction orthogonal to the thickness direction of the metal layer 31. The plurality of recesses 40 are, for example, arranged side by side at predetermined intervals along the X-axis direction. As shown in FIG. 1, in the condenser 13, the plurality of recesses 40 are arranged side by side along the X-axis direction on the Y-axis direction opposite sides of the flow channel 13*r* (specifically, the flow channel r2). Each of the recesses 40, for example, extends along the Y-axis direction. As shown in FIG. 2, the recess 40 extends along a plane direction (the Y-axis direction in this case) of the outer face 31B of the metal layer 31. The recess 40 is, for example, provided to be separate from a corresponding one of outer side faces 31C of the metal layer 31. In addition, the recess 40 is, for example, provided to be separate from a corresponding one of inner wall faces of the through hole 32X in the Y-axis direction. That is, the recess 40 is provided only in a corresponding Y-axis direction intermediate portion of the outer face 31B in the pipe wall 31*w*.

As shown in FIG. 2 and FIG. 3, each of inner wall faces of the recesses 40 is, for example, formed to extend vertically to the outer face 31B. The inner wall face of the recess 40 is, for example, formed in a plane extending along the Z-axis direction. A bottom face of the recess 40 is, for example, formed in a plane parallel to the outer face 31B. The bottom face of the recess 40 is, for example, formed in the plane extending in parallel with an XY plane. Incidentally, the inner wall face of the recess 40 may be formed into a tapered shape that is widened from the bottom face side toward an opening side.

(Configuration of Metal Layer 33)

As shown in FIG. 2, the metal layer 33 is deposited on the lower face of the metal layer 32. The metal layer 33 has an inner face 33A (an upper face in this case) that is bonded to the metal layer 32, and an outer face 33B (a lower face in this case) that is provided on an opposite side to the inner face 33A in the thickness direction (the Z-axis direction in this case) of the metal layer 33. The metal layer 33 has pipe walls 33*w* that are provided at positions overlapping the pipe walls 32*w* in plan view, and a lower wall 33*d* that is provided at a position overlapping the flow channel 13*r* in plan view. The inner face 33A in each of the pipe walls 33*w* is bonded to the lower face in a corresponding one of the pipe walls 32*w*. The lower wall 33*d* is provided between a pair of the pipe walls 33*w*. The inner face 33A in the lower wall 33*d* is exposed to the flow channel 13*r*. In other words, the lower wall 33*d* constitutes the flow channel 13*r*.

The metal layer 33 has one or more recesses 50 provided in the outer face 33B. The recesses 50 are provided so as not to overlap the flow channel 15, specifically the flow channel 13*r*, in plan view. The recesses 50 are provided in the outer face 33B of the pipe walls 33*w*. The recesses 50 are, for example, provided in both the pair of the pipe walls 33*w*. The recesses 50 are not provided in the outer face 33B of the lower wall 33*d*. Each of the recesses 50 is, for example, formed to be recessed from the outer face 33B of the metal layer 33 to a corresponding one of thicknesswise intermediate portions of the metal layer 33. Each of the recesses 50 is, for example, formed to extend from the outer face 33B of the metal layer 33 to a corresponding one of thicknesswise central portions of the metal layer 33.

As shown in FIG. 3, the metal layer 33 has the recesses 50 that are arranged side by side along one direction (the X-axis direction in this case) of the plane direction orthogonal to the thickness direction of the metal layer 33. The recesses 50 are, for example, arranged side by side along the X-axis direction at predetermined intervals. Each of the recesses 50 is provided so as not to overlap any one of the recesses 40 in plan view. The recess 50 is, for example, provided so as not to overlap any entire one of the recesses 40 in plan view. The recesses 50 are arranged side by side along the X-axis direction at enough intervals not overlapping the recesses 40. A width dimension of each of the recesses 50 along the X-axis direction is, for example, equal to a width dimension of each of the recesses 40 along the X-axis direction. For example, an interval between two of the recesses 50 adjacent in the X-axis direction is larger than the width dimension of each recess 40, 50.

As shown in FIG. 1, in the condenser 13, the recesses 50 are arranged side by side along the X-axis direction on the Y-axis direction opposite sides of the flow channel 13*r*

(specifically, the flow channel r2). Each of the recesses 50, for example, extends along the Y-axis direction. The recess 50, for example, extends in parallel with the recesses 40. A length dimension of the recess 50 along the Y-axis direction is, for example, equal to a Y-axis direction length dimension of the recess 40 which is adjacent to the recess 50 in the X-axis direction.

As shown in FIG. 2, each of the recesses 50 is, for example, provided to be separate from a corresponding one of outer side faces 33C of the metal layer 33. In addition, the recess 50 is, for example, provided to be separate from a corresponding one of the inner wall faces of the through hole 32X in the Y-axis direction. That is, the recess 50 is provided in only a corresponding Y-axis direction intermediate portion of the outer face 33B in the pipe wall 33*w*.

As shown in FIG. 2 and FIG. 3, each of inner wall faces of the recesses 50 is, for example, formed to extend vertically to the outer face 33B. The inner wall face of the recess 50 is, for example, formed in a plane extending along the Z-axis direction. A bottom face of the recess 50 is, for example, formed in a plane parallel to the outer face 33B. The bottom face of the recess 50 is, for example, formed in the plane extending parallel to the XY plane. Incidentally, the inner wall face of the recess 50 may be formed into a tapered shape that is widened from the bottom face side toward an opening side.

(Specific Structure of Flow Channel 13*r*)

As shown in FIG. 2, the flow channel 13*r* is constituted by the through hole 32X of the metal layer 32. The flow channel 13*r* is formed by a space surrounded by the inner wall faces of the through hole 32X, the inner face 31A of the upper wall 31*u*, and the inner face 33A of the lower wall 33*d*.

(Specific Structure of Pipe Wall 13*w*)

Each of the pipe walls 13*w* is, for example, constituted by the pipe wall 31*w* of the metal layer 31, the pipe wall 32*w* of the metal layer 32, and the pipe wall 33*w* of the metal layer 33.

(Configuration of Vapor Pipe 12)

As shown in FIG. 3, the vapor pipe 12 is formed by the three metal layers 31 to 33 stacked on one another in a manner similar to or the same as the condenser 13. For example, in the vapor pipe 12, the through hole 32Y that penetrates the metal layer 32, that is an inner metal layer, in the thickness direction is formed so that the flow channel 12*r* is formed. The vapor pipe 12 has the pair of the pipe walls 12*w* provided on the opposite sides in the width direction (the X-axis direction in this case) that is orthogonal to the length direction (the Y-axis direction in this case) of the vapor pipe 12. For example, no hole or groove is formed in each of the pipe walls 12*w*.

(Configuration of Liquid Pipe 14)

The liquid pipe 14 is formed by the three metal layers 31 to 33 stacked on one another in a manner similar to or the same as the condenser 13. In the liquid pipe 14, a through hole 32Z that penetrates the metal layer 32, that is the inner metal layer, in the thickness direction is formed so that the flow channel 14*r* is formed. The liquid pipe 14 has the pair of pipe walls 14*w* provided on the opposite sides in the width direction (the X-axis direction in this case) that is orthogonal to the length direction (the Y-axis direction in this case) of the liquid pipe 14. For example, no hole or groove is formed in each of the pipe walls 14*w*. The liquid pipe 14 may, for example, have a porous body. The porous body is, for example, configured to have first bottomed holes recessed from the upper face of the metal layer 32 that is the inner metal layer, second bottomed holes recessed from the lower face of the metal layer 32, and pores formed by partial communication between the first bottomed holes and the second bottomed holes. The porous body, for example, guides the working fluid C liquefied in the condenser 13 to the evaporator 11 (see FIG. 1) by capillary force generated in the porous body. In addition, although now shown, an injection port for injecting the working fluid C (see FIG. 1) is provided in the liquid pipe 14. However, the injection port is sealed by a sealing material so that the inside of the loop heat pipe 10 is kept airtight.

(Configuration of Evaporator 11)

The evaporator 11 shown in FIG. 1 is formed by the three metal layers 31 to 33 (see FIG. 3) stacked on one another in a manner similar to or the same as the vapor pipe 12, the condenser 13 and the liquid pipe 14 shown in FIG. 3. The evaporator 11 may, for example, have a porous body in a manner similar to or the same as the liquid pipe 14. For example, in the evaporator 11, the porous body provided in the evaporator 11 is formed into a comb teeth shape. Inside the evaporator 11, a space is formed in a region where the porous body is not provided.

Thus, the loop heat pipe 10 has a configuration in which the three metal layers 31 to 33 (see FIG. 2 and FIG. 3) are stacked on one another. Incidentally, the number of the stacked metal layers is not limited to three, but can be set at four or more.

(Effects of Loop Heat Pipe 10)

Next, effects of the loop heat pipe 10 will be described.

The loop heat pipe 10 has the evaporator 11 for vaporizing a working fluid C, the vapor pipe 12 for guiding the vaporized working fluid (i.e. vapor Cv) to flow into the condenser 13, the condenser 13 for liquefying the vapor Cv, and the liquid pipe 14 for guiding the liquefied working fluid C to flow into the evaporator 11. The vapor Cv generated in the evaporator 11 by heat of the heating component is guided to the condenser 13 through the vapor pipe 12. The vapor Cv is liquefied in the condenser 13. That is, the heat generated in the heating component is dissipated in the condenser 13. As a result, the heating component is cooled so that an increase in temperature of the heating component can be suppressed.

As shown in FIG. 2 and FIG. 3, in the condenser 13, the recesses 40 are provided in the outer face 31B of the metal layer 31, that is an outer metal layer, and the recesses 50 are provided in the outer face 33B of the metal layer 33, that is an outer metal layer. In this manner, a surface area in the outer face 31B, 33B of the metal layer 31, 33 can be increased in comparison with a case where the recesses 40, 50 are not provided. Therefore, the surface area that can contact outside air in the metal layer 31, 33 can be increased, and an amount of heat exchange with the outside air can be increased, in comparison with the case where the recesses 40, 50 are not provided. As a result, efficiency of the heat exchange, i.e. heat dissipation performance, in the condenser 13 can be improved.

In the present embodiment, the metal layer 31 is an example of a first outer metal layer, the metal layer 32 is an example of the inner metal layer, and the metal layer 33 is an example of a second outer metal layer. In addition, the inner face 31A is an example of a first inner face, the outer face 31B is an example of a first outer face, the inner face 33A is an example of a second inner face, and the outer face 33B is an example of a second outer face. Moreover, the recess 40 is an example of a first recess, and the recess 50 is an example of a second recess.

(Method for Manufacturing Loop Heat Pipe 10)

Next, a method for manufacturing the loop heat pipe 10 will be described.

Figures 4A, 4B, 4C, 4D:
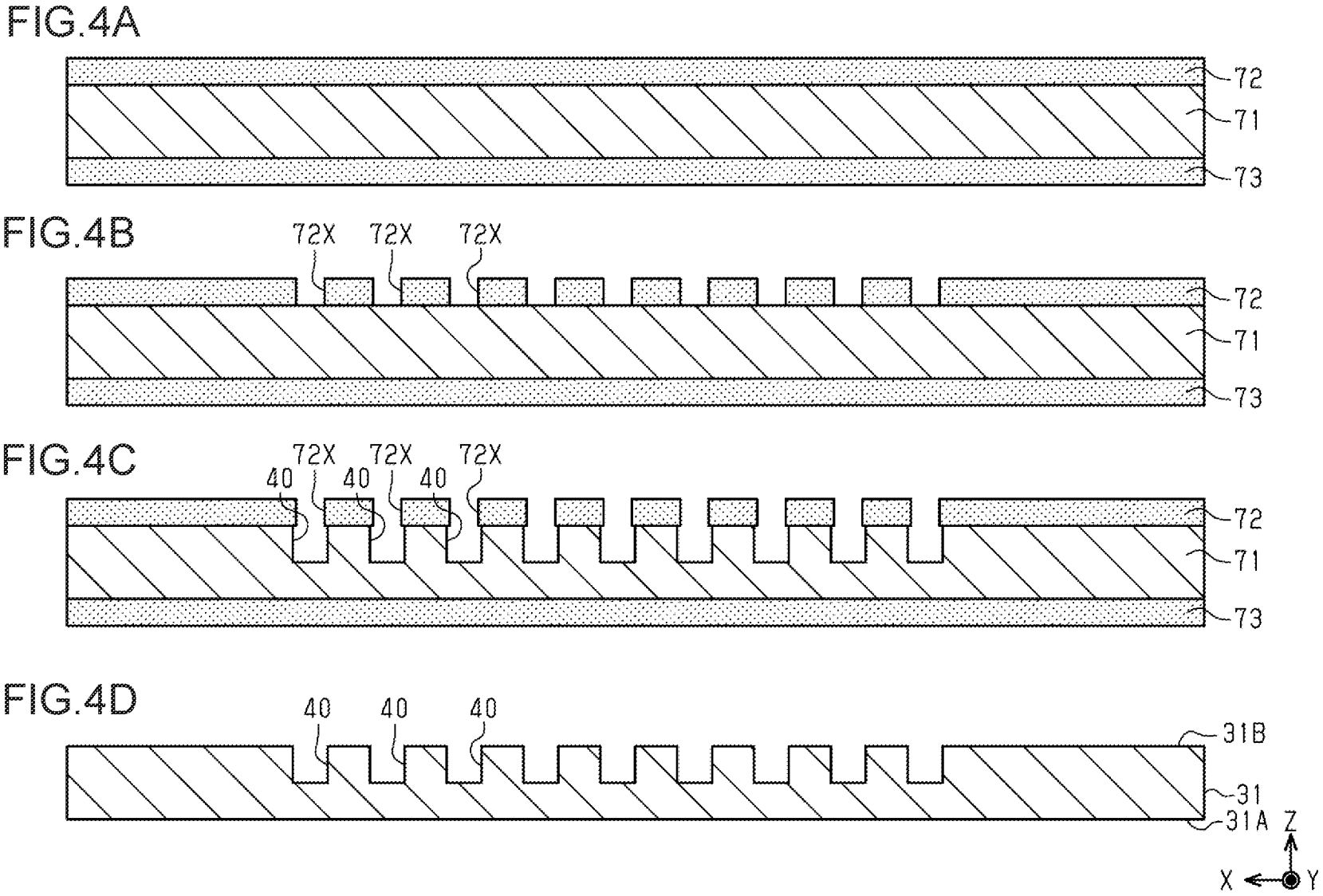
FIGS. 4A to 4D are schematic sectional views showing a method for manufacturing the loop heat pipe according to the embodiment.

First, in a step shown in FIG. 4A, a flat plate-like metal sheet 71 is prepared. The metal sheet 71 is a member that will ultimately become a metal layer 31 (see FIG. 3). The metal sheet 71 is, for example, made of copper, stainless steel, aluminum, a magnesium alloy, or the like. Thickness of the metal sheet 71 can be, for example, set in a range of about 50 μm to 200 μm.

Subsequently, a resist layer 72 is formed on an upper face of the metal sheet 71, and a resist layer 73 is formed on a lower face of the metal sheet 71. For example, a photosensitive dry film resist, or the like, can be used as each of the resist layers 72 and 73.

Next, in a step shown in FIG. 4B, the resist layer 72 is exposed to light and developed so that opening portions 72X for selectively exposing the upper face of the metal sheet 71 are formed in the resist layer 72. The opening portions 72X are formed to correspond to recesses 40 shown in FIG. 3.

Subsequently, in a step shown in FIG. 4C, the metal sheet 71 exposed inside the opening portions 72X is etched from the upper face side of the metal sheet 71. Thus, the recesses 40 are formed in the upper face of the metal sheet 71. The recesses 40 can be, for example, formed by wet etching applied to the metal sheet 71 with the resist layers 72 and 73 as etching masks. When copper is used as the material of the metal sheet 71, a ferric chloride aqueous solution or a cupric chloride aqueous solution can be used as an etching solution.

Next, the resist layers 72 and 73 are stripped off by a stripping solution. Thus, the metal layer 31 having the recesses 40 in an outer face 31B can be formed, as shown in FIG. 4D.

Figures 5A, 5B, 5C, 5D:
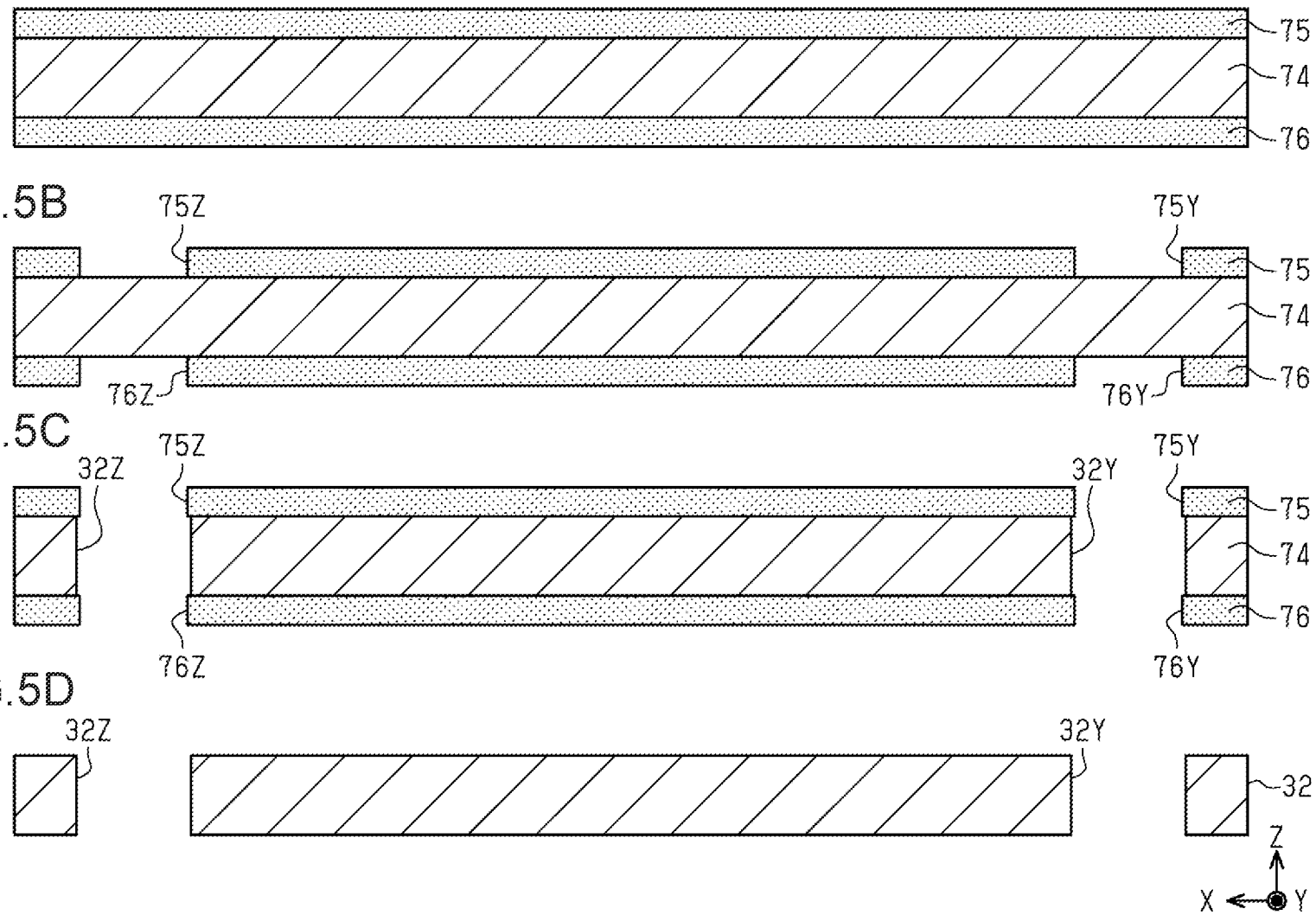
FIGS. 5A to 5D are schematic sectional views showing the method for manufacturing the loop heat pipe according to the embodiment.

Next, in a step shown in FIG. 5A, a flat plate-like metal sheet 74 is prepared. The metal sheet 74 is a member that will ultimately become a metal layer 32 (see FIG. 3). The metal sheet 74 is, for example, made of copper, stainless steel, aluminum, a magnesium alloy, or the like. Thickness of the metal sheet 74 can be, for example, set in a range of about 50 μm to 200 μm.

Subsequently, a resist layer 75 is formed on an upper face of the metal sheet 74, and a resist layer 76 is formed on a lower face of the metal sheet 74. For example, a photosensitive dry film resist, or the like, can be used as each of the resist layers 75 and 76.

Next, in a step shown in FIG. 5B, the resist layer 75 is exposed to light and developed so that openings portions 75Y and 75Z for selectively exposing the upper face of the metal sheet 74 are formed in the resist layer 75. In a similar manner or the same manner, the resist layer 76 is exposed to light and developed so that opening portions 76Y and 76Z for selectively exposing the lower face of the metal sheet 74 are formed in the resist layer 76. The opening portions 75Y and 76Y are formed to correspond to a through hole 32Y shown in FIG. 3. The opening portions 75Z and 76Z are formed to correspond to a through hole 32Z shown in FIG. 3. The opening portion 75Y and the opening portion 76Y are provided at positions overlapping each other in plan view. The opening portion 75Z and the opening portion 76Z are provided at positions overlapping each other in plan view.

Next, in a step shown in FIG. 5C, the metal sheet 74 exposed from the resist layers 75 and 76 is etched from the opposite upper and lower faces of the metal sheet 74. Due to the opening portions 75Y and 76Y, the through hole 32Y is formed in the metal sheet 74. Moreover, due to the opening portions 75Z and 76Z, the through hole 32Z is formed in the metal sheet 74. The through holes 32Y and 32Z can be, for example, formed by wet etching applied to the metal sheet 74 with the resist layers 75 and 76 as etching masks. When copper is used as the material of the metal sheet 74, a ferric chloride aqueous solution or a cupric chloride aqueous solution can be used as an etching solution. Incidentally, although not shown, a through hole 32X (see FIG. 2) can be formed in a manner similar to or the same as the through holes 32Y and 32Z.

Next, the resist layers 75 and 76 are stripped off by a stripping solution. Thus, the metal layer 32 having the through holes 32Y and 32Z and the through hole 32X (see FIG. 2) can be formed, as shown in FIG. 5D.

Subsequently, in a step shown in FIG. 6A, a metal layer 33 having recesses 50 in an outer face 33B is formed by a method similar to or the same as the steps shown in FIGS. 4A to 4D. Next, the metal layer 32 is disposed between the metal layer 31 and the metal layer 33.

Figures 6A, 6B:
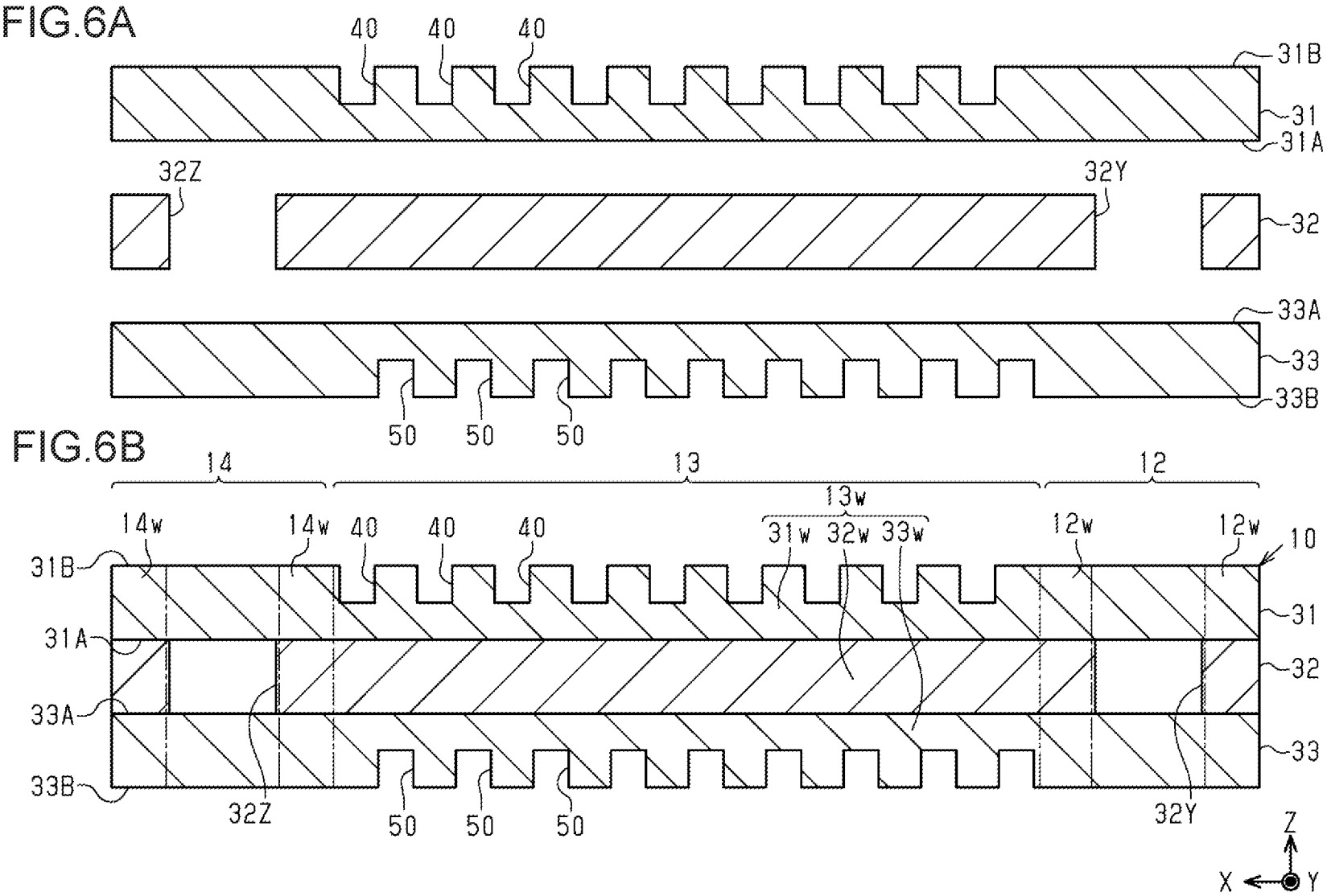
FIGS. 6A and 6B are schematic sectional views showing the method for manufacturing the loop heat pipe according to the embodiment.

Next, in a step shown in FIG. 6B, the metal layers 31 to 33 stacked on one another are pressed while being heated at a predetermined temperature (e.g. about 900° C.) so that the metal layers 31 to 33 are bonded to one another by solid-phase bonding. Thus, the metal layers 31, 32, and 33 adjacent in the stacking direction are directly bonded. On this occasion, an inner face 31A (the lower face in this case) in pipe walls 31*w* and the upper face in pipe walls 32*w* are directly bonded. Here, the through hole 32X (see FIG. 2) and the recesses 50 are not formed in portions overlapping the recesses 40 in plan view in the metal layers 31 to 33. Therefore, no space is formed in any of the portions overlapping the recesses 40 in plan view in the metal layers 31 to 33. Thus, pressure can be suitably applied to the lower face 31A of the metal layer 31 and the upper face of the metal layer 32 during the pressing, so that the lower face 31A of the metal layer 31 and the upper face of the metal layer 32 can be suitably bonded. In a similar manner or the same manner, an inner face 33A (the upper face in this case) of the metal layer 33 and the lower face of the metal layer 32 are directly bonded. Here, the through hole 32X (see FIG. 2) and the recesses 40 are not formed in portions overlapping the recesses 50 in plan view in the metal layers 31 to 33. Therefore, no space is formed in any of the portions overlapping the recesses 50 in plan view in the metal layers 31 to 33. Thus, pressure can be suitably applied to the inner face 33A of the metal layer 33 and the lower face of the metal layer 32 during the pressing, so that the inner face 33A of the metal layer 33 and the lower face of the metal layer 32 can be suitably bonded.

By the aforementioned steps, a structure body in which the metal layers 31, 32 and 33 are stacked on one another is formed. A loop heat pipe 10 having an evaporator 11, a vapor pipe 12, a condenser 13 and a liquid pipe 14 as shown in FIG. 1 is formed. After, for example, air inside the liquid pipe 14 is then exhausted by a vacuum pump or the like, a working fluid C is injected into the liquid pipe 14 from a not-shown injection port, and then, the injection port is sealed.

Next, the effects and functions of the present embodiment will be described.

(1) The recesses 40 are provided in the outer face 31B of the metal layer 31, that is an outer metal layer. Thus, the surface area in the outer face 31B of the metal layer 31 can be increased in comparison with the case where the recesses 40 are not provided. For example, due to the provision of the recesses 40, the surface area in the outer face 31B of the metal layer 31 can be increased without enlarging the planar shape of the condenser 13. Therefore, the surface area that can contact outside air in the metal layer 31 can be increased, and an amount of heat exchange with the outside air can be increased, in comparison with the case where the recesses 40 are not provided. As a result, efficiency of the heat exchange, i.e. heat dissipation performance, in the loop heat pipe 10 can be improved.

(2) The recesses 40 are provided so as not to overlap the flow channel 15 in plan view. That is, the recesses 40 are not provided in a portion of the metal layer 31 overlapping the flow channel 15 in plan view, i.e. in the outer face 31B in the upper wall 31*u*. Therefore, reduction in thickness of the upper wall 31*u* constituting the flow channel 15 can be prevented, so that lowering of rigidity in the upper wall 31*u* can be prevented.

(3) The recesses 50 are provided in the outer face 33B of the metal layer 33, which is an outer metal layer. Thus, the surface area in the outer face 33B of the metal layer 33 can be increased in comparison with the case where the recesses 50 are not provided. For example, due to the provision of the recesses 50, the surface area in the outer face 33B of the metal layer 33 can be increased without enlarging the planar shape of the condenser 13. Therefore, the surface area that can contact outside air in the metal layer 33 can be increased, and an amount of heat exchange with the outside air can be increased, in comparison with the case where the recesses 50 are not provided. As a result, the heat dissipation performance in the loop heat pipe 10 can be improved.

(4) The recesses 50 are provided so as not to overlap the flow channel 15 in plan view. That is, the recesses 50 are not provided in a portion of the metal layer 33 overlapping the flow channel 15 in plan view, i.e. in the outer face 33B in the lower wall 33*d*. Therefore, reduction in thickness of the lower wall 33*d* which constitutes the flow channel 15 can be prevented, and lowering of rigidity in the lower wall 33*d* can be prevented.

(5) The recesses 50 are provided so as not to overlap the recesses 40 in plan view. In the metal layers 31 to 33 according to this configuration, the flow channel 15 and the recesses 50 are not formed in portions overlapping the recesses 40 in plan view, and the flow channel 15 and the recesses 40 are not formed in portions overlapping the recesses 50 in plan view. Therefore, in the metal layers 31 to 33, no space is formed in any of the portions overlapping the recesses 40 in plan view, and no space is formed in any of the portions overlapping the recesses 50 in plan view. Thus, during the pressing for bonding the metal layers 31 to 33 to one another, pressure can be suitably applied to the inner face 31A of the metal layer 31 and the upper face of the metal layer 32, and pressure can be suitably applied to the inner face 33A of the metal layer 33 and the lower face of the metal layer 32. As a result, the inner face 31A of the metal layer 31 and the upper face of the metal layer 32 can be suitably bonded, and the inner face 33A of the metal layer 33 and the lower face of the metal layer 32 can be suitably bonded.

(6) The recesses 40 are formed to be recessed from the outer face 31B of the metal layer 31 to the thicknesswise intermediate portions of the metal layer 31. According to this configuration, the rigidity of the metal layer 31 can be suitably prevented from being lowered due to the provision of the recesses 40, in comparison with the case where the recesses 40 are, for example, formed so as to penetrate the metal layer 31 in the thickness direction. Therefore, lowering in handleability of the metal layer 31 as a single unit during the manufacturing process can be suitably prevented.

(7) The recesses 40 are provided to be separate from the outer side faces 31C of the metal layer 31. According to this configuration, portions where the recesses 40 are not formed, i.e. the portions whose thicknesses are not reduced are provided between the outer side faces 31C of the metal layer 31 and the recesses 40. Therefore, pressure can be suitably applied to the inner face 31A of the metal layer 31 and the upper face of the metal layer 32 in the portions between the outer side faces 31C of the metal layer 31 and the recesses 40 during the pressing for bonding the metal layers 31 to 33 to one another. As a result, the inner face 31A of the metal layer 31 and the upper face of the metal layer 32 can be suitably bonded.

OTHER EMBODIMENTS

The aforementioned embodiment can be modified and implemented as follows. The aforementioned embodiment and any of the following modifications can be combined with each other and implemented as long as they are not technically contradictory to each other.

Figure 7:
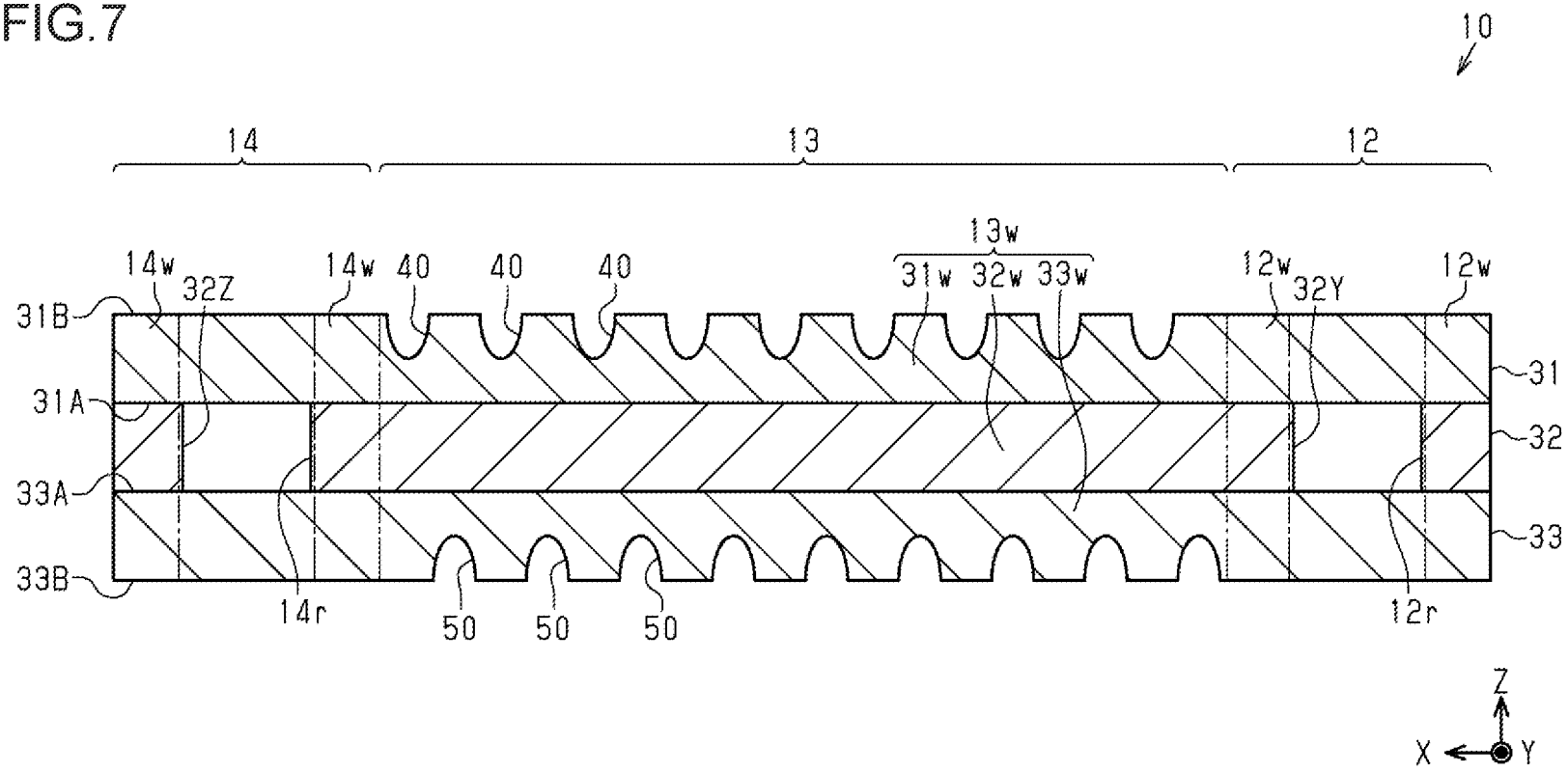
FIG. 7 is a schematic sectional view showing a loop heat pipe according to a modification.

The sectional shape of each of the recesses 40, 50 in the aforementioned embodiment is not particularly limited. For example, as shown in FIG. 7, the inner face of the recess 40, 50 may be formed into an arc-shaped curved face in sectional view. The inner face of the recess 40, 50 may be formed into a concave shape that is a semi-circular shape or a semi-elliptical shape in section. Here, in the present specification, the "semi-circular shape" includes not only a semi-circle bisecting a perfect circle, but also, for example, a circular shape longer or shorter in arc than the semi-circle. Furthermore, in the present specification, the "semi-elliptical shape" includes not only a semi-ellipse bisecting an ellipse, but also, for example, an elliptical shape longer or shorter in arc than the semi-ellipse. The inner face of the recess 40, 50 in this modification is formed into the semi-elliptical shape in section. Incidentally, the radius of curvature of the bottom face of the recess 40, 50 and the radius of curvature of each of the inner wall faces of the recess 40, 50 may be equal to each other or may be different from each other.

Figure 8:
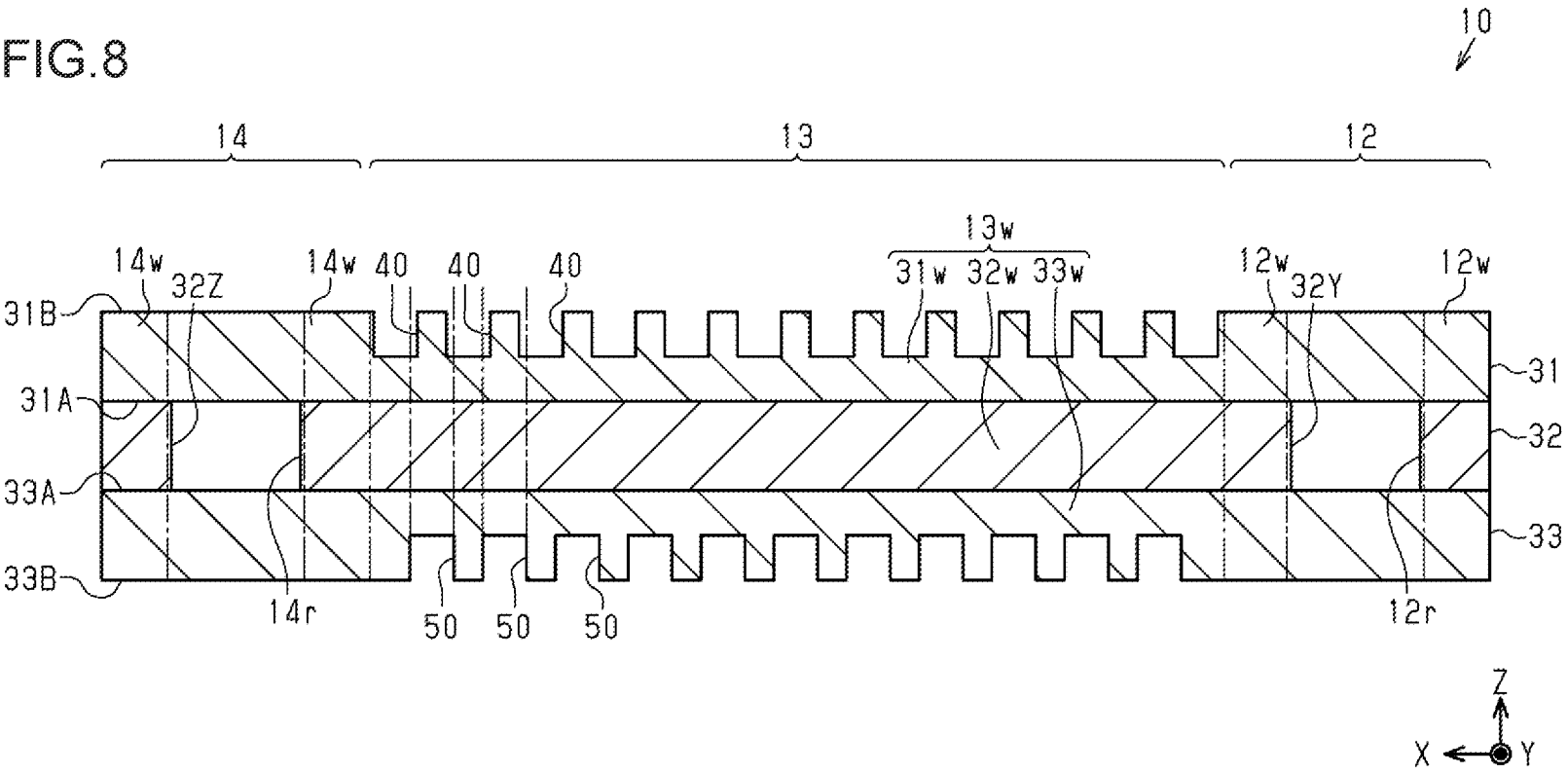
FIG. 8 is a schematic sectional view showing a loop heat pipe according to a modification.

In the aforementioned embodiment, the recesses 50 are provided so as not to overlap the recesses 40 in plan view. However, the recesses 50 are not limited thereto. For example, as shown in FIG. 8, the recesses 50 may be provided so as to partially overlap the recesses 40 in plan view. That is, portions of the recesses 50 in this modification overlap portions of the recesses 40 in plan view.

Figure 9:
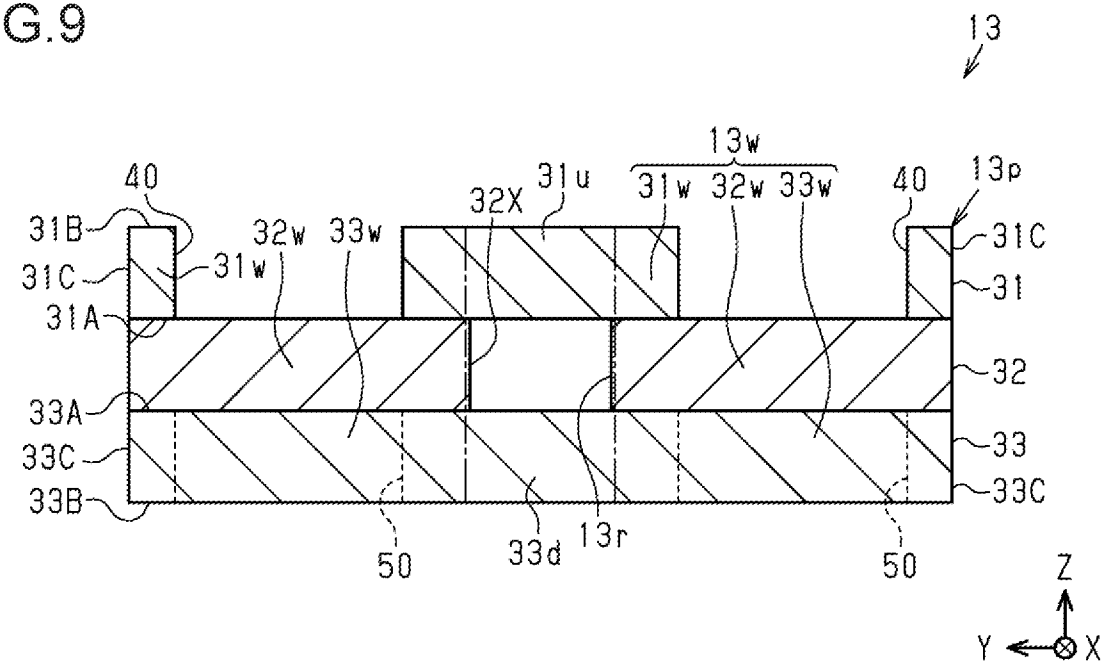
FIG. 9 is a schematic sectional view showing a loop heat pipe according to a modification.

In the aforementioned embodiment, each of the recesses 40 is formed to be recessed from the outer face 31B of the metal layer 31 to a corresponding one of the thicknesswise central portions of the metal layer 31. However, the depth of the recess 40 is not limited thereto. For example, as shown in FIG. 9, the recess 40 may be formed to penetrate the metal layer 31 in the thickness direction. That is, the recess 40 may be formed into a through hole. According to this configuration, as the depth of the recess 40 is larger, each of the inner wall faces of the recess 40 exposed to the outside is larger accordingly. Therefore, the surface area that can contact the outside air in the metal layer 31 can be increased. Thus, heat dissipation performance in the condenser 13 can be improved.

In a manner similar to or the same as the aforementioned embodiment, the recess 40 constituted by the through hole is, for example, also provided to be separate from the corresponding outer side face 31C of the metal layer 31. Moreover, the recess 40 constituted by the through hole is, for example, provided to be separate from the corresponding inner wall face of the through hole 32X in the Y-axis direction.

In the case where each of the recesses 40 is formed into the through hole, the handleability of the metal layer 31 as a single unit during the manufacturing process is lowered easily. Therefore, it is preferable that the recess 40 is formed to penetrate the metal layer 31 in the thickness direction within a range in which desired handleability can be maintained. For example, only some of the plurality of recesses 40 may be formed to penetrate the metal layer 31 in the thickness direction.

In the aforementioned embodiment, each of the recesses 50 is formed from the outer face 33B of the metal layer 33 to a corresponding one of the thicknesswise central portions of the metal layer 33. However, the depth of the recess 50 is not limited thereto. For example, as shown in FIG. 9, the recesses 50 may be formed to penetrate the metal layer 33 in the thickness direction. That is, each of the recesses 50 may be formed into a through hole. According to this configuration, as the depth of the recess 50 is larger, each of the inner wall faces of the recess 50 exposed to the outside is larger accordingly. Therefore, the surface area that can contact the outside air in the metal layer 33 can be increased. Thus, the heat dissipation performance in the condenser 13 can be improved.

In a manner similar to or the same as the aforementioned embodiment, the recess 50 constituted by the through hole is, for example, also provided to be separate from the corresponding outer side face 33C of the metal layer 33. Moreover, the recess 50 constituted by the through hole is, for example, provided to be separate from the corresponding inner wall face of the through hole 32X in the Y-axis direction.

In the case where each of the recesses 50 is formed into the through hole, handleability of the metal layer 33 as a single unit during the manufacturing process is lowered easily. Therefore, it is preferable that the recess 50 is formed to penetrate the metal layer 33 in the thickness direction within a range in which desired handleability can be maintained.

Figure 10:
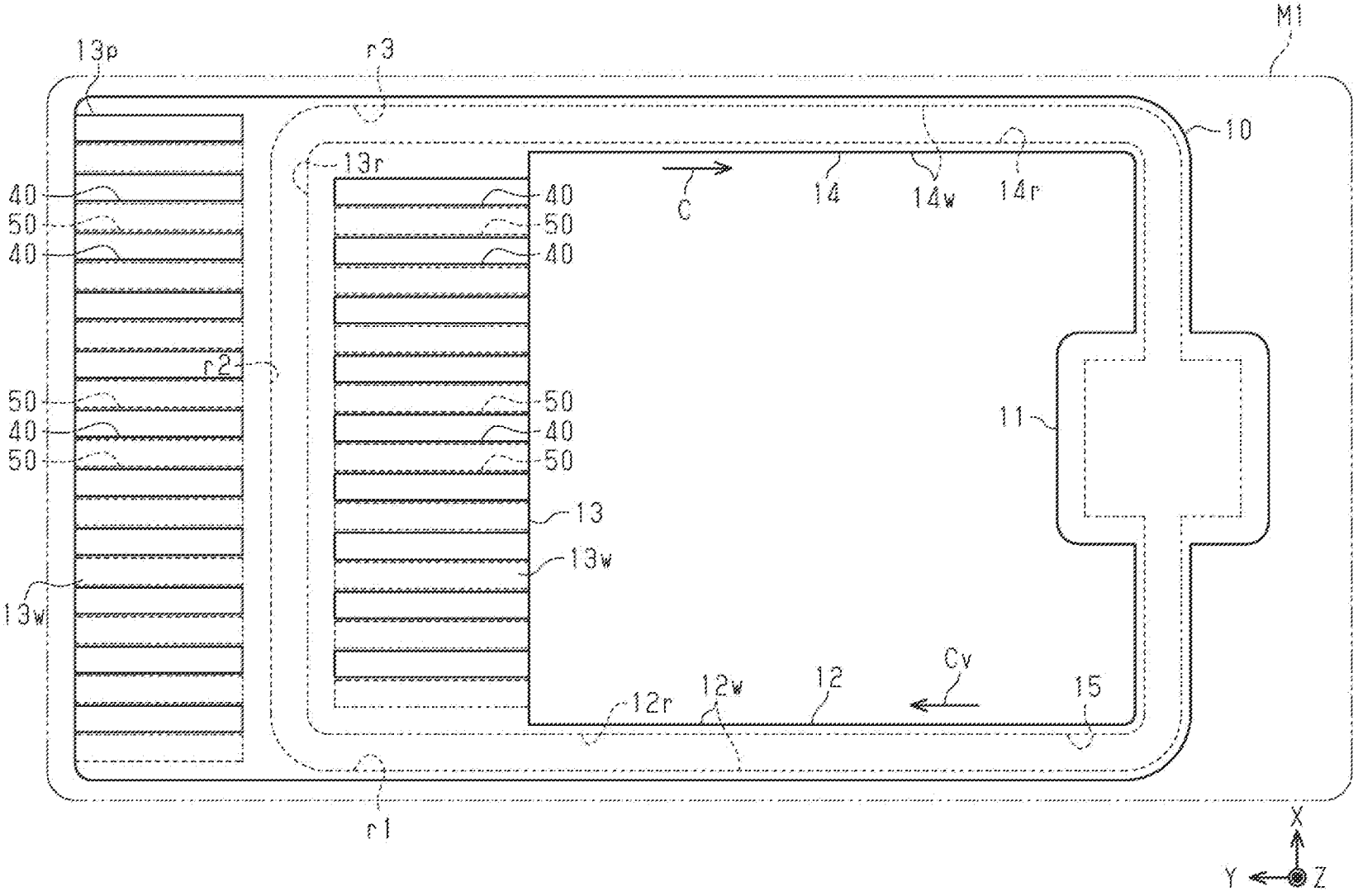
FIG. 10 is a schematic plan view showing a loop heat pipe according to a modification.

In the aforementioned embodiment, the recesses 40, 50 are provided at positions separate from the outer side faces of the pipe walls 13*w*. However, the recesses 40, 50 are not limited thereto. For example, as shown in FIG. 10, the recesses 40, 50 may be formed to extend to the outer side faces of the pipe walls 13*w*. Each of the recesses 40, 50 in this case is, for example, formed to be open in the Y-axis direction. That is, the recess 40, 50 in this modification is formed in the shape of a notch.

The planar shape of the recess 40, 50 in the aforementioned embodiment is not particularly limited. The recess 40, 50 can be formed into any shape in plan view. For example, the planar shape of the recess 40, 50 can be appropriately changed in accordance with the shape of the condenser 13 as a whole, the direction of flow of the outside air, etc.

Figure 11:
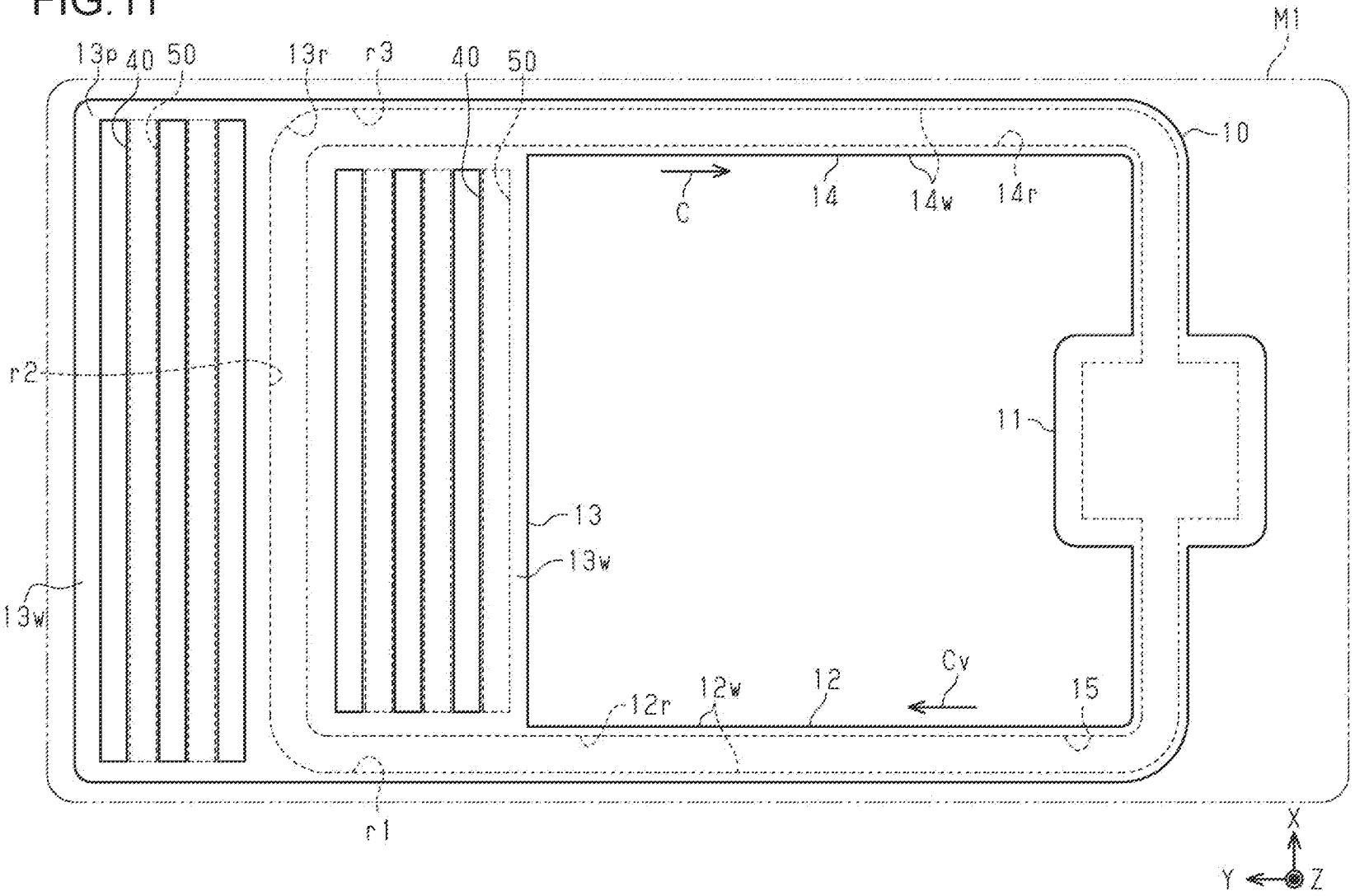
FIG. 11 is a schematic plan view showing a loop heat pipe according to a modification.

For example, as shown in FIG. 11, each of the recesses 40, 50 may be formed to extend along the X-axis direction in the XY plane. In this case, for example, the plurality of recesses 40 are arranged side by side along the Y-axis direction, and the plurality of recesses 50 are arranged side by side along the Y-axis direction.

Figure 12:
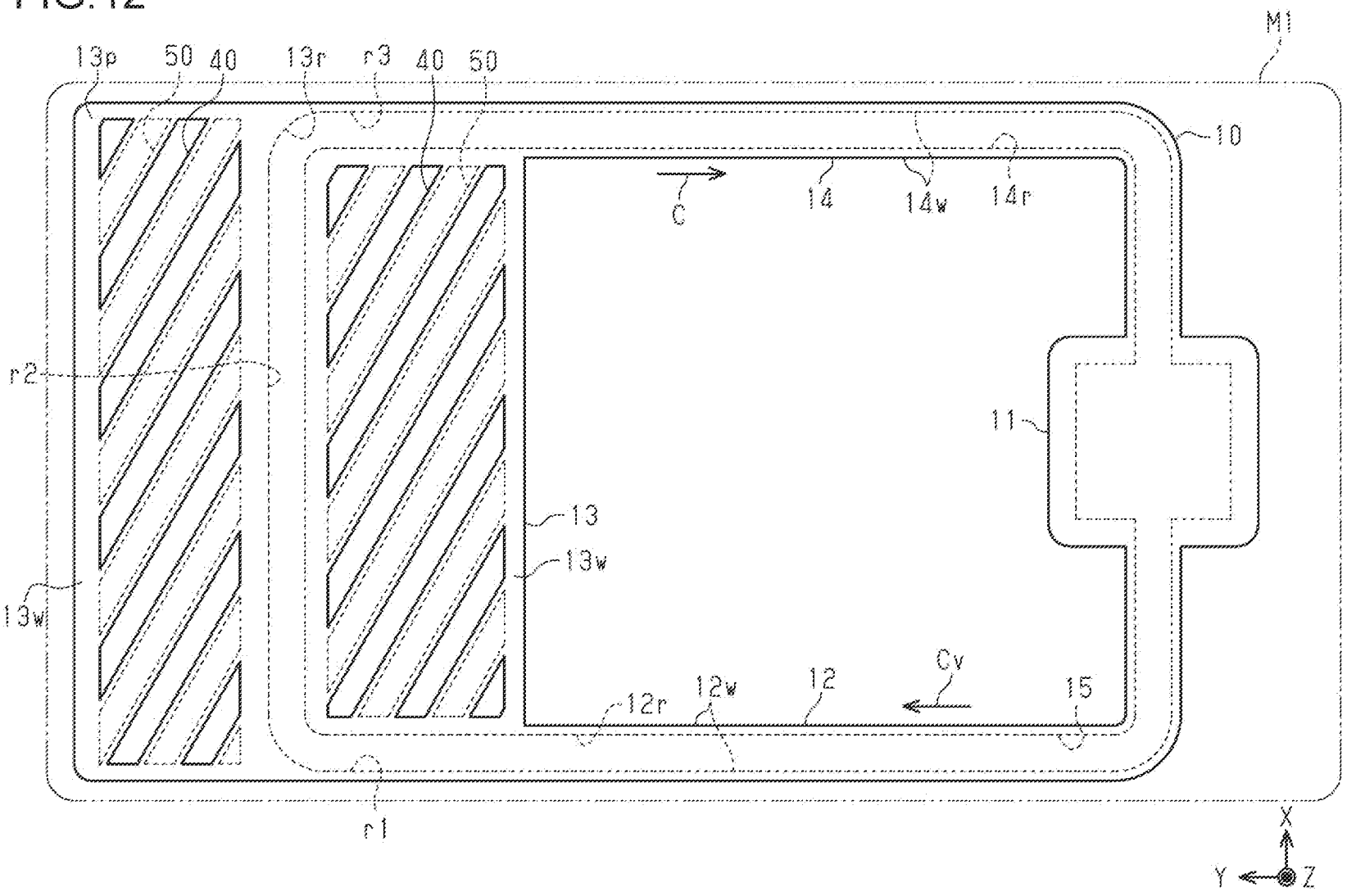
FIG. 12 is a schematic plan view showing a loop heat pipe according to a modification.

For example, as shown in FIG. 12, each of the recesses 40, 50 may be formed to extend in a first direction crossing both the X-axis direction and the Y-axis direction in the XY plane. In this case, for example, the plurality of recesses 40 are arranged side by side along a second direction orthogonal to the first direction in the XY plane, and the plurality of recesses 50 are arranged side by side along the second direction.

Figure 13:
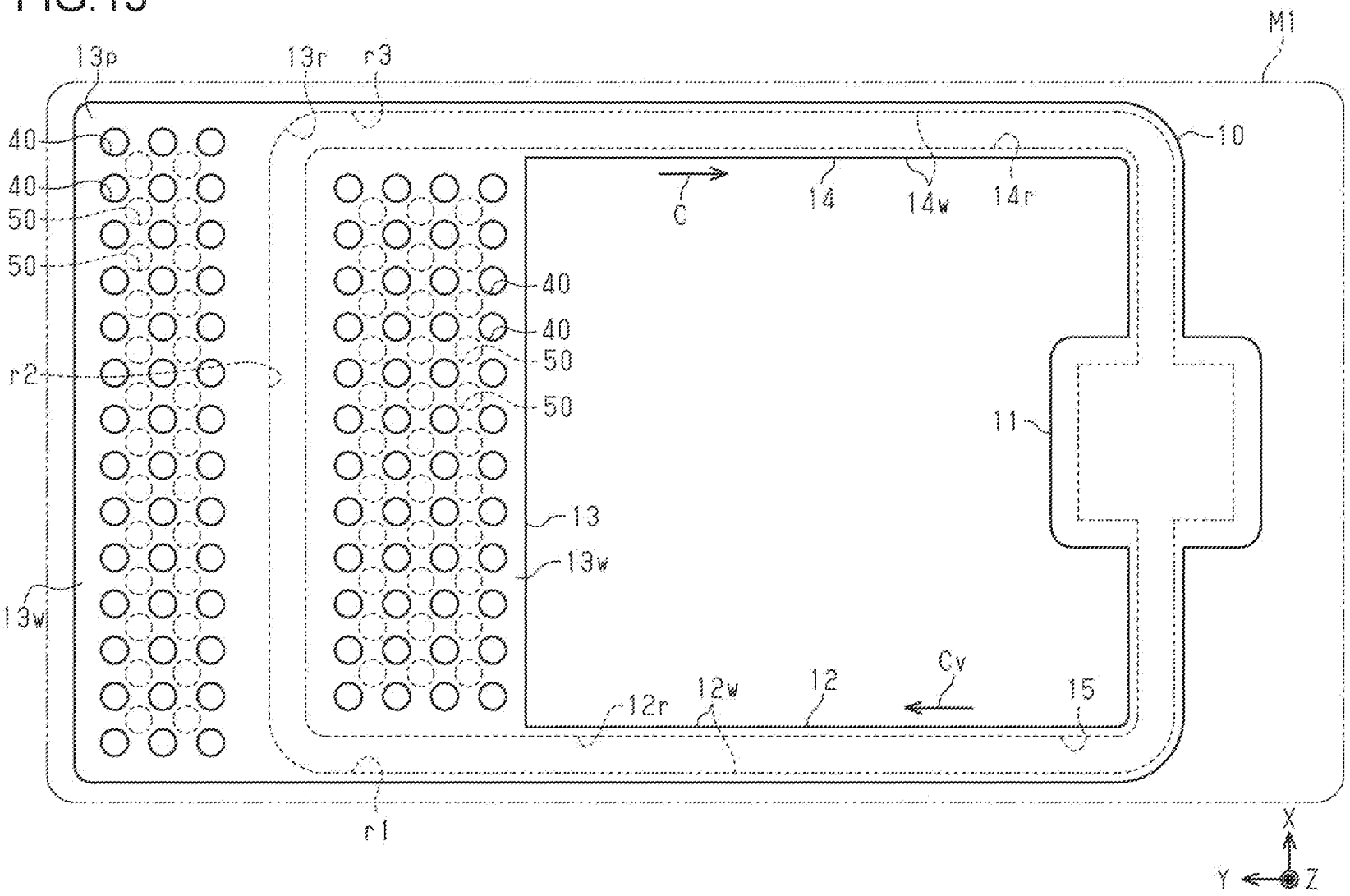
FIG. 13 is a schematic plan view showing a loop heat pipe according to a modification.

For example, as shown in FIG. 13, each of the recesses 40, 50 may be formed into the shape of a circle in plan view. In this modification, the plurality of recesses 40 are provided in the form of a matrix in the XY plane, and the plurality of recesses 50 are provided in the form of a matrix in the XY plane.

Figure 14:
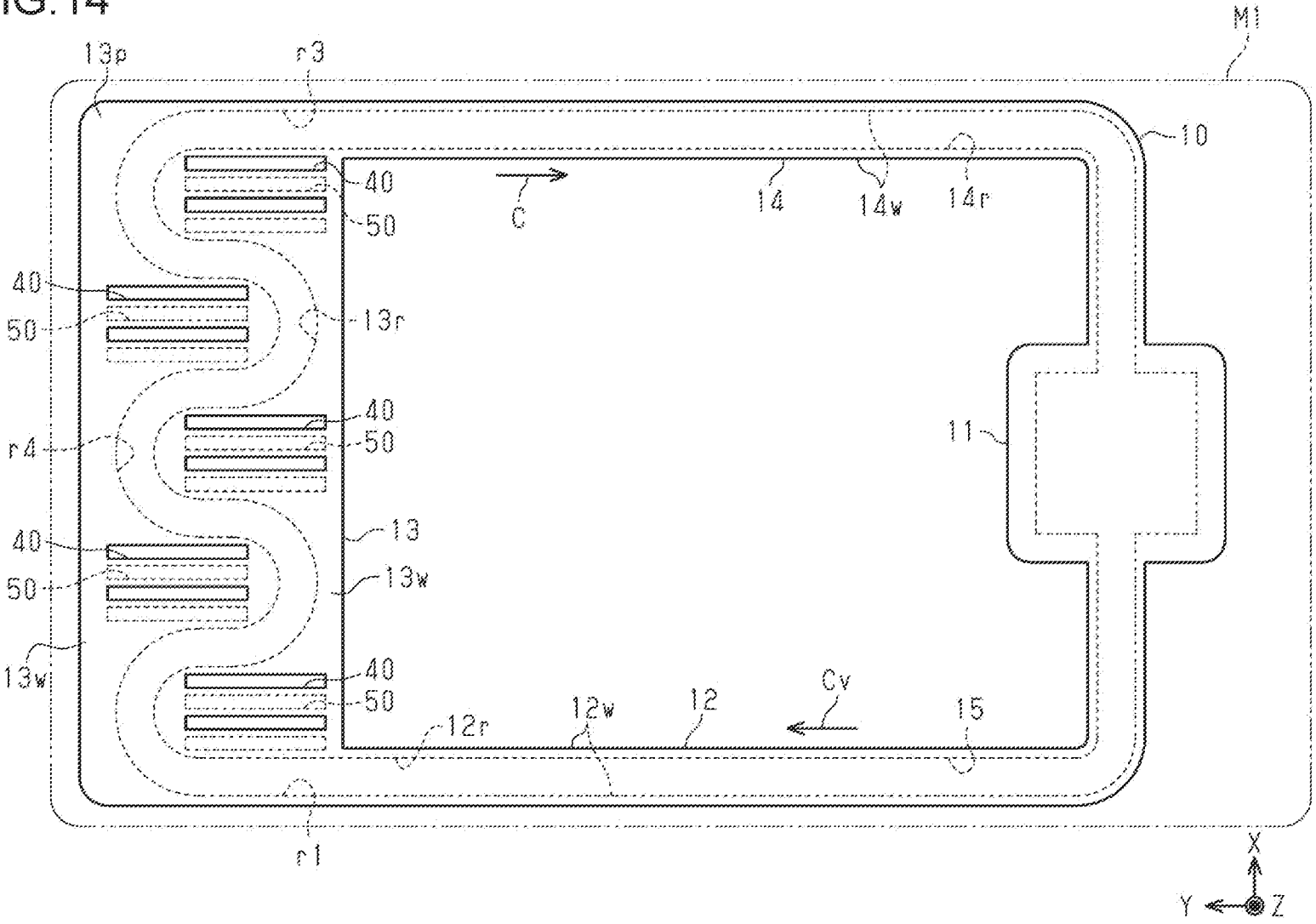
FIG. 14 is a schematic plan view showing a loop heat pipe according to a modification.

The shape of the flow channel 13*r* in the condenser 13 according to the aforementioned embodiment is not particularly limited. For example, as shown in FIG. 14, the flow channel 13*r* may be formed into a shape having a meandering portion r4 that meanders in the XY plane. The flow channel 13*r* in this modification has a flow channel r1 extending in the Y-axis direction, the meandering portion r4 extending in the X-axis direction from an end portion of the flow channel r1 while meandering, and a flow channel r3 extending in the Y-axis direction from an end portion of the meandering portion r4. Even in this case, the recesses 40, 50 are provided so as not to overlap the flow channel 13*r* in plan view.

Figure 15:
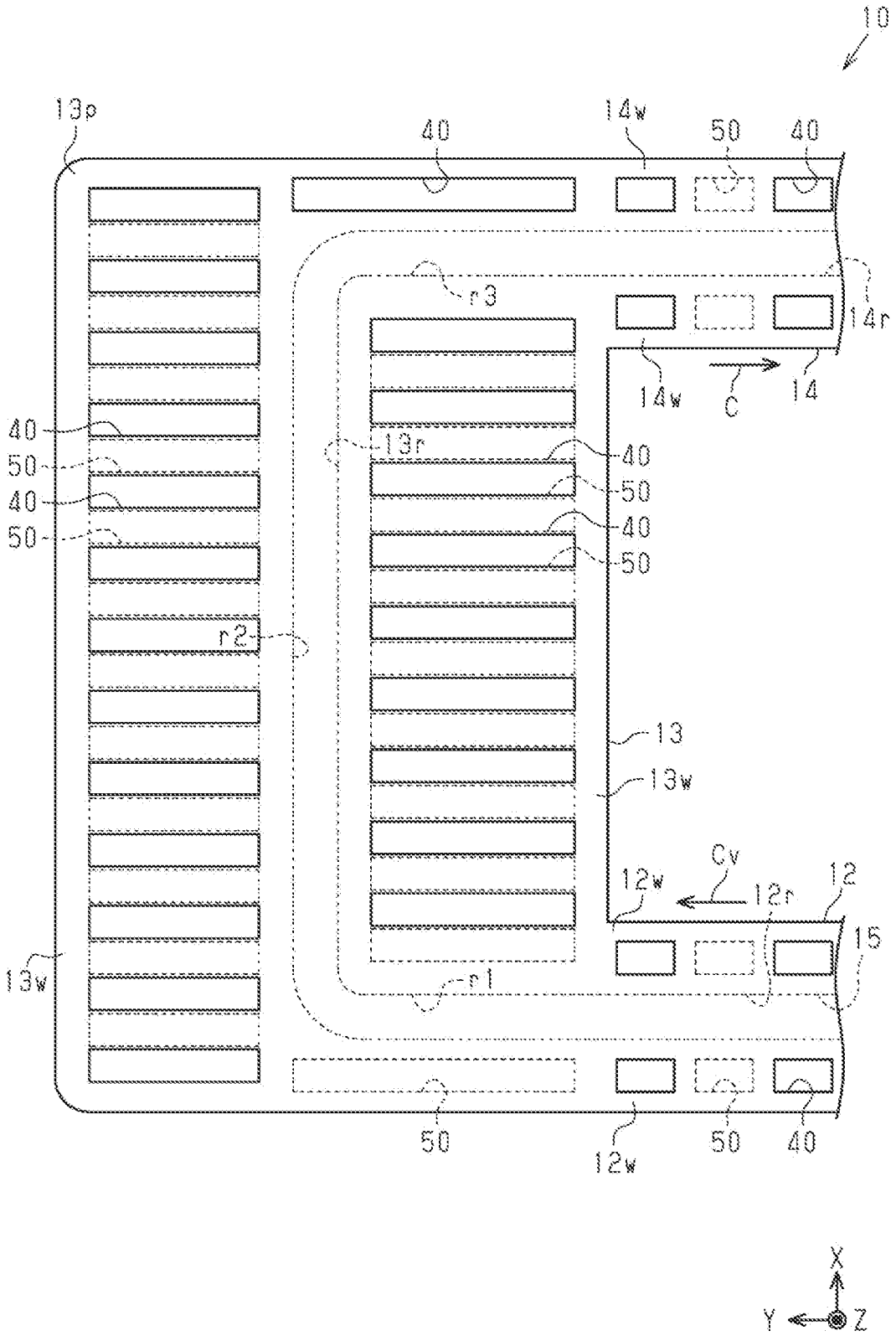
FIG. 15 is a schematic plan view showing a loop heat pipe according to a modification.

In the aforementioned embodiment, the recesses 40, 50 are provided in the pipe walls 13*w* of the condenser 13. However, the recesses 40, 50 are not limited thereto. For example, as shown in FIG. 15, the recesses 40, 50 may be provided in the pipe walls 12*w* of the vapor pipe 12. The recesses 40, 50 in this case are provided so as not to overlap the flow channel 15, specifically the flow channel 12*r*, in plan view.

Moreover, the recesses 40, 50 may be provided in the pipe walls 14*w* of the liquid pipe 14. The recesses 40, 50 in this case are provided so as not to overlap the flow channel 15, specifically the flow channel 14*r*, in plan view.

In the modification shown in FIG. 15, the recesses 40, 50 in the pipe walls 13*w* of the condenser 13 may be omitted. In the aforementioned embodiment, the plurality of recesses 40 may be formed into different shapes from one another.

In the aforementioned embodiment, the plurality of recesses 50 may be formed into different shapes from one another. In the aforementioned embodiment, the recesses 40 and the recesses 50 may be formed into different shapes from each other.

In the aforementioned embodiment, the recesses 50 may be omitted. In the aforementioned embodiment, the inner metal layer is constituted by only the single metal layer 32. That is, the inner metal layer is formed into a single layer structure. However, the inner metal layer is not limited thereto. For example, the inner metal layer may be formed into a laminated structure in which a plurality of metal layers are stacked on one another. The inner metal layer in this case is constituted by the plurality of metal layers stacked between the metal layer 31 and the metal layer 33.

Although the preferred embodiments etc. have been described above in detail, the present disclosure is not limited to the aforementioned embodiments etc., and various modifications and substitutions can be added to the aforementioned embodiments etc. without departing from the scope described in Claims.

What is claimed is:

1. A loop heat pipe comprising:

an evaporator configured to vaporize a working fluid;

a condenser configured to liquefy the working fluid;

a liquid pipe that connects the evaporator and the condenser to each other;

a vapor pipe that connects the evaporator and the condenser to each other; and a flow channel that is provided in the liquid pipe, the vapor pipe and the condenser to allow the working fluid to flow therethrough, wherein at least one of the condenser, the liquid pipe and the vapor pipe comprises:

a first outer metal layer which defines an outer surface of the at least one of the condenser, the liquid pipe, and the vapor pipe;

a second outer metal layer; and an inner metal layer that is provided between the first outer metal layer and the second outer metal layer, the first outer metal layer comprises:

a first inner face that contacts the inner metal layer;

a first outer face opposite side to the first inner face in a thickness direction of the first outer metal layer; and a first recess that is provided in the first outer face so as not to overlap the flow channel in plan view, and each of the evaporator, the condenser and the liquid pipe comprises the first outer metal layer, the second outer metal layer and the inner metal layer.

* * * * *